US005887289A

United States Patent [19]

Theoret

[11] Patent Number: 5,887,289

[45] Date of Patent: Mar. 30, 1999

[54] SAFETY CAP WITH REMOVABLE FABRIC COVER

[76] Inventor: Normand Theoret, 405 François Leber, Laprairie, Québec, Canada, J5R 5M1

[21] Appl. No.: 965,928

[22] Filed: Nov. 7, 1997

Related U.S. Application Data

[60] Provisional application No. 60/050,229 Jun. 19, 1997.

[51] Int. Cl.[6] ..... A42B 3/00

[52] U.S. Cl. ..... 2/425; 2/411; 2/195.1

[58] Field of Search ..... 2/410, 411, 412, 2/42, 425, 175.6, 195.1, 909

[56] References Cited

U.S. PATENT DOCUMENTS

| | | | |
|---|---|---|---|
| 2,333,987 | 11/1943 | Dandy . | |
| 2,983,923 | 5/1961 | Aileo . | |
| 3,103,015 | 9/1963 | Plastino | 2/422 |
| 3,263,235 | 8/1966 | Young | 2/422 |
| 3,268,911 | 8/1966 | Cox . | |
| 3,280,402 | 10/1966 | Scheibchen . | |
| 3,286,275 | 11/1966 | Marchello . | |
| 3,315,273 | 4/1967 | Bullard . | |
| 3,329,968 | 7/1967 | Gordon . | |
| 3,364,499 | 1/1968 | Kwoka . | |
| 3,387,304 | 6/1968 | Simpson et al. . | |
| 3,389,405 | 6/1968 | Fattori . | |
| 3,631,539 | 1/1972 | Massa . | |
| 3,711,864 | 1/1973 | Dickstein . | |
| 3,783,450 | 1/1974 | O'Connor . | |
| 3,787,894 | 1/1974 | Goodman, Jr. . | |
| 3,818,508 | 6/1974 | Lammers et al. . | |
| 3,820,163 | 6/1974 | Rappleyea . | |
| 3,877,076 | 4/1975 | Summers et al. . | |
| 3,878,562 | 4/1975 | Lamb . | |
| 3,882,547 | 5/1975 | Morgan . | |
| 3,909,846 | 10/1975 | Zahn . | |
| 3,946,441 | 3/1976 | Johnson . | |
| 3,992,721 | 11/1976 | Morton . | |
| 4,321,708 | 3/1982 | Troiano . | |
| 5,226,180 | 7/1993 | Leach | 2/411 |
| 5,289,591 | 3/1994 | Anderson | 2/411 |
| 5,519,895 | 5/1996 | Barnes, Jr. | 2/422 |

FOREIGN PATENT DOCUMENTS

| | | |
|---|---|---|
| PCT/AU90/00494 | 10/1990 | Australia . |
| 1123551 | 5/1982 | Canada . |
| 1141102 | 2/1983 | Canada . |

*Primary Examiner*—Michael A. Neas

[57] ABSTRACT

This safety cap comprises a unitary shell made of a rigid, light weight and impact-resistant plastic material and forming a dome shaped body to fit the wearer's head with ventilation openings and a rear recess for the passage of a wearer's pony tail. An air permeable fabric cover completely covers the shell body for the purpose of thermal insulation, for esthetic value and for preventing entering of insects through the shell ventilation openings while allowing ventilation within the shell body. The fabric cover has a dependent flange which is folded around the exposed edge of the shell body and attached to the interior surface of the shell body by hook and loop fastener bands. This flange is padded and extends around the wearer's head. The rear portion of the cover has also a recess in register with the shell body recess and is provided with length adjustable fastening straps to secure the cap in position.

14 Claims, 3 Drawing Sheets

Fig. 4
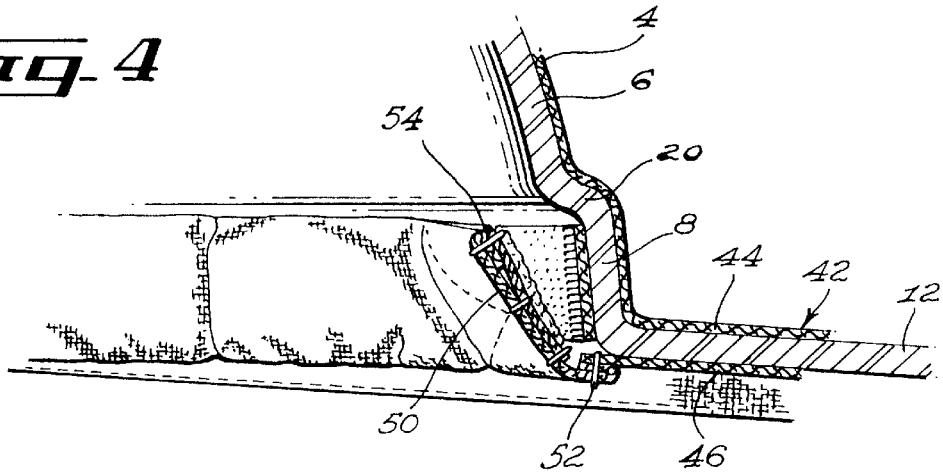
Fig. 5
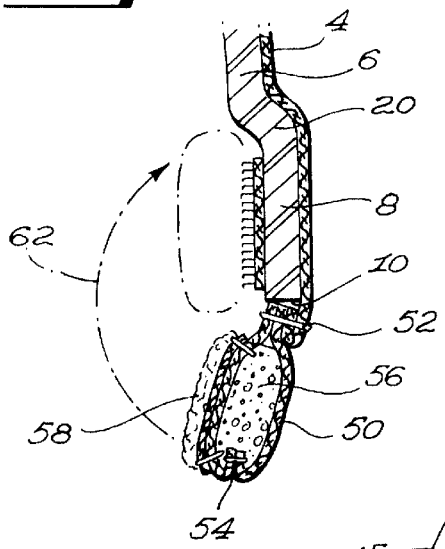
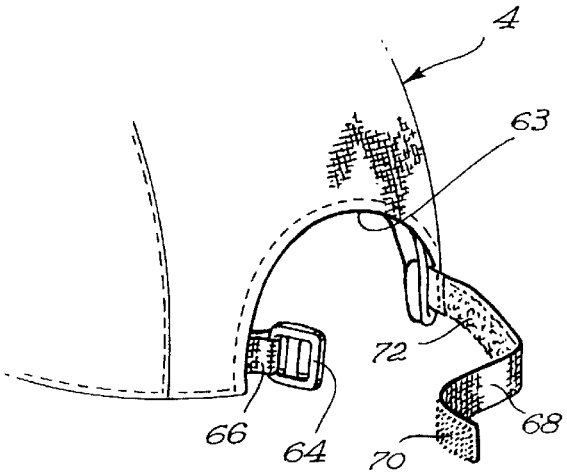
Fig. 6
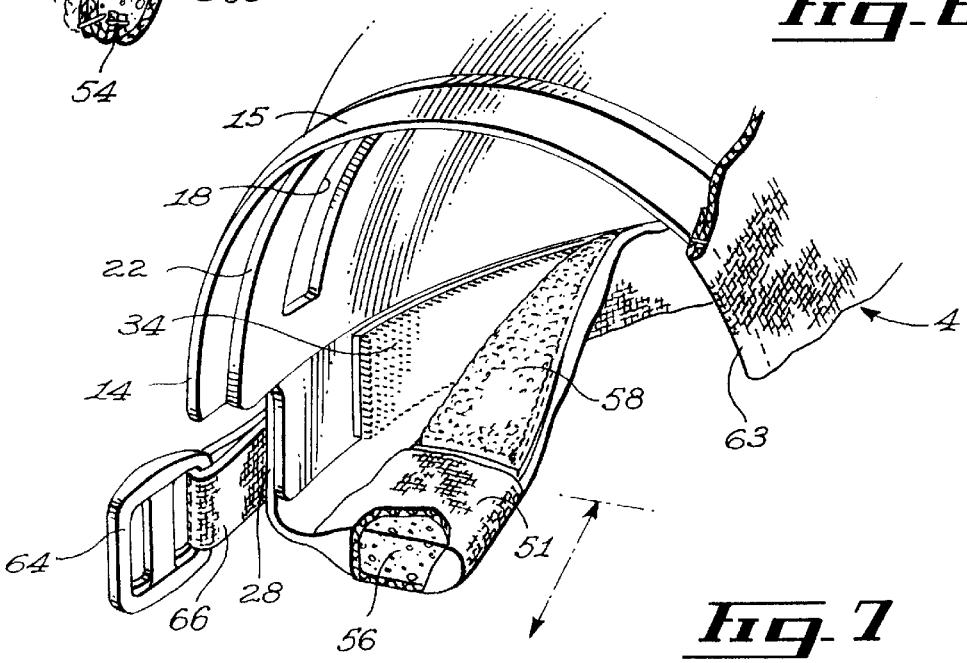
Fig. 7

SAFETY CAP WITH REMOVABLE FABRIC COVER

This application claims benefit of provisional application Ser. No. 60/050,229 filed Jun. 19, 1997.

FIELD OF THE INVENTION

The present invention relates to head caps, and more particularly to safety caps for outdoor use, more particularly for golfers and golf maintenance personnel.

BACKGROUND OF THE INVENTION

Head injuries can be very severe when high velocity objects impact with the head. This is true in many sports, such as golf and baseball. Rigid, impact-resistant baseball safety caps are known but they do not protect against biting insects and they lack in air ventilation and in esthetic value. Known golf caps made of fabric with different patterns and colors have an esthetic value, are useful for thermally insulating the wearer's head, are air permeable to allow head ventilation and provide a barrier against insects. However they cannot resist an impact.

U.S. Pat. No. 3,315,273 issued Apr. 25, 1967 to E. C. Bullard and entitled "Safety cap" shows and describes a safety cap to be used by industrial and commercial workers. It comprises a rigid, impact-resistant shell having a front visor and a cloth cover adapted to fully cover the shell; the shell has no ventilation openings and the cloth cover is snapped onto the outer surface of the rigid shell by means of studs outwardly protruding from the shell rim. The purpose of the cloth cover is to prevent electrical static charge, adjustment of the cap to different head sizes is accomplished by forming the shell into a plurality of segments obtained by vertical slots in the shell. These slots cannot provide air ventilation since they are covered by an inside padding made of sponge rubber and not air permeable.

OBJECTS OF THE INVENTION

It is the object of the present invention to improve upon the safety cap described in the Bullard patent and to adapt it for use by golfers and golf maintenance personnel.

A more specific object of the present invention to provide a safety cap which includes a impact-resisting shell and a cloth cover therefor, the cloth cover being easily installed and removed for washing or cleaning, the cloth cover being air permeable to allow for ventilation.

Another object of the present invention is to provide a safety cap of character described provided with adjusting means to fit the cap to different sizes of wearer's heads.

Another object of the present invention is to provide ventilation inside of the safety cap.

Another object of the present invention is to provide a cover which is padded at its marginal flange and which serves to cushion the shell and space the same from the wearer's head.

SUMMARY OF THE INVENTION

The safety cap of the present invention comprises one piece shell made of an impact-resistant, rigid material and forming a dome shaped wearer's head fitting body defining a top portion and a lower head encircling rim with an exposed edge, said body having ventilation openings made therethrough and extending short of said rim, a cloth cover covering said body down to said exposed edge and having a foldable dependent flange which, when not folded, hangs down loosely from said cover along said exposed edge and which when folded underlies and covers said exposed edge and is applied against the inside of said rim, and fastener means for releasably securing said flange folded against the inside of said rim, said cloth cover completely covering said body including said ventilation openings but being air permeable.

Preferably, the flange forms a sleeve enclosing a cushioning pad.

Preferably, the fastener means include releasably interhooking hook and loop fastener bands adhered to said flange and to the inside of said rim.

Preferably, each of said body and cover has a back recess with opposite side edges, said opposite side edges of said body recess formed with enlargements at the level of said rim, said cover back recess registering with said body back recess except for said enlargements, said sleeve and enclosed cushioning pad having end portions which, when said flange is folded, freely extend within said enlargements, and length adjustable fastener straps secured to said cover and extending across both said back recesses and said enlargements.

Preferably, the cap includes a visor integral with and forwardly extending from said body, said cloth cover forming a rearwardly opened front pocket for receiving and snugly covering said visor, said pocket defining a top and and bottom layer, said flange secured to and extending along said bottom layer, said flange completely surrounding the wearer's head except at said body and cover back recesses.

Preferably, said body is formed of a thin molded plastic sheet and said rim is outwardly offset relative to said body to reinforce the latter.

Preferably, said body is further formed with body reinforcing outwardly offset vertical zones disposed between said ventilation openings.

Preferably, the cap further includes an additional cushioning pad adhered to the inside of the top portion of said body, said top portion being provided with circular ventilation openings, said additional pad having holes in register with said circular ventilation openings.

BRIEF DESCRIPTION OF THE DRAWINGS

FIG. 4 is a partial vertical section of the assembled shell and cover;

FIG. 5 is a cross-section taken through the cover, as shown at line 5—5 of FIG. 3, showing how the cover is assembled with the shell;

FIG. 6 is a partial rear perspective view of the cover; and

FIG. 7 is a partial rear perspective view of the shell and assembled cover shown in partial cross-section and being assembled with the shell.

DETAILED DESCRIPTION OP THE PREFERRED EMBODIMENT

Figure 1:
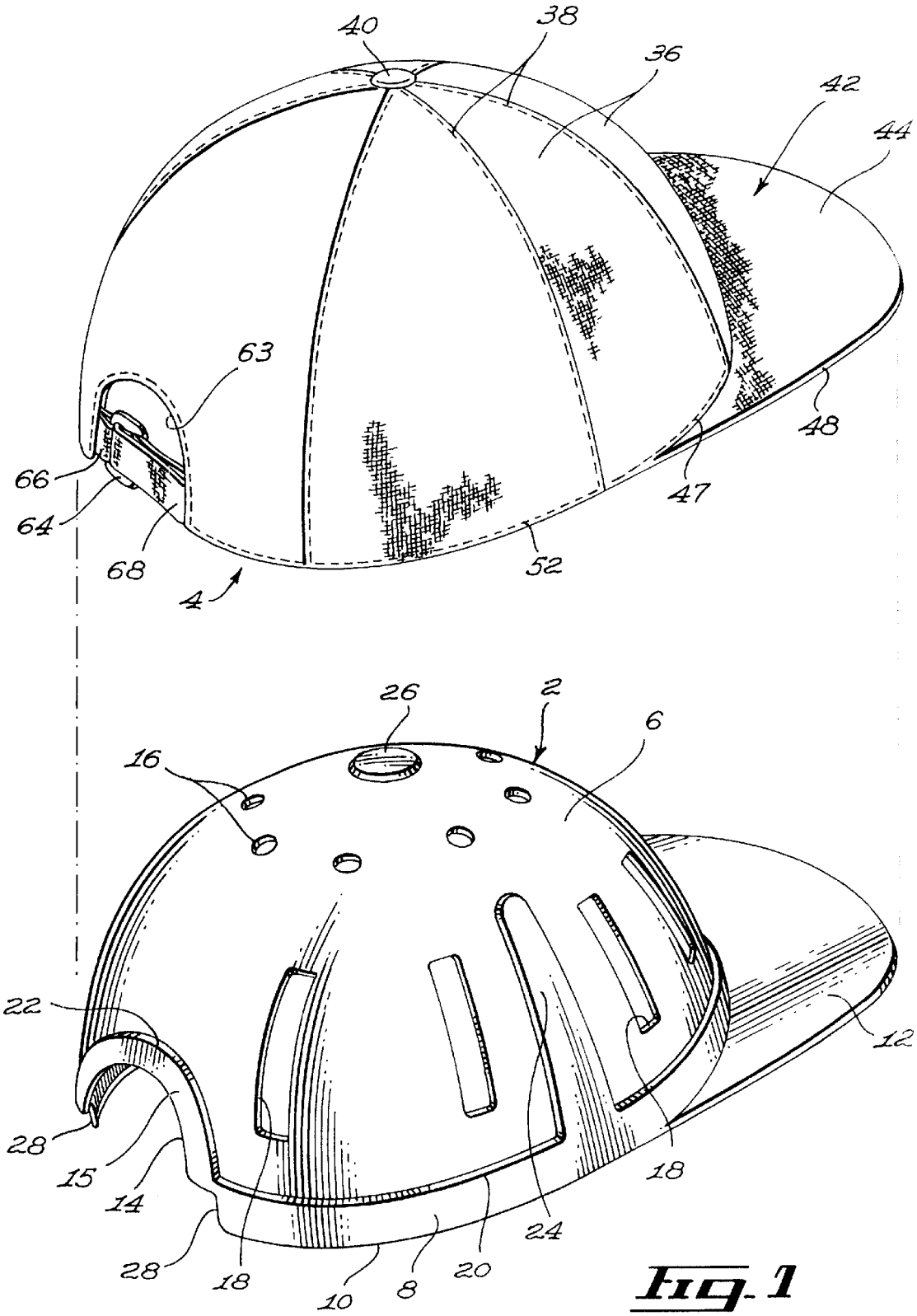
FIG. 1 is an exploded perspective view of the shell and cover forming the cap of the invention.
Figure 2:
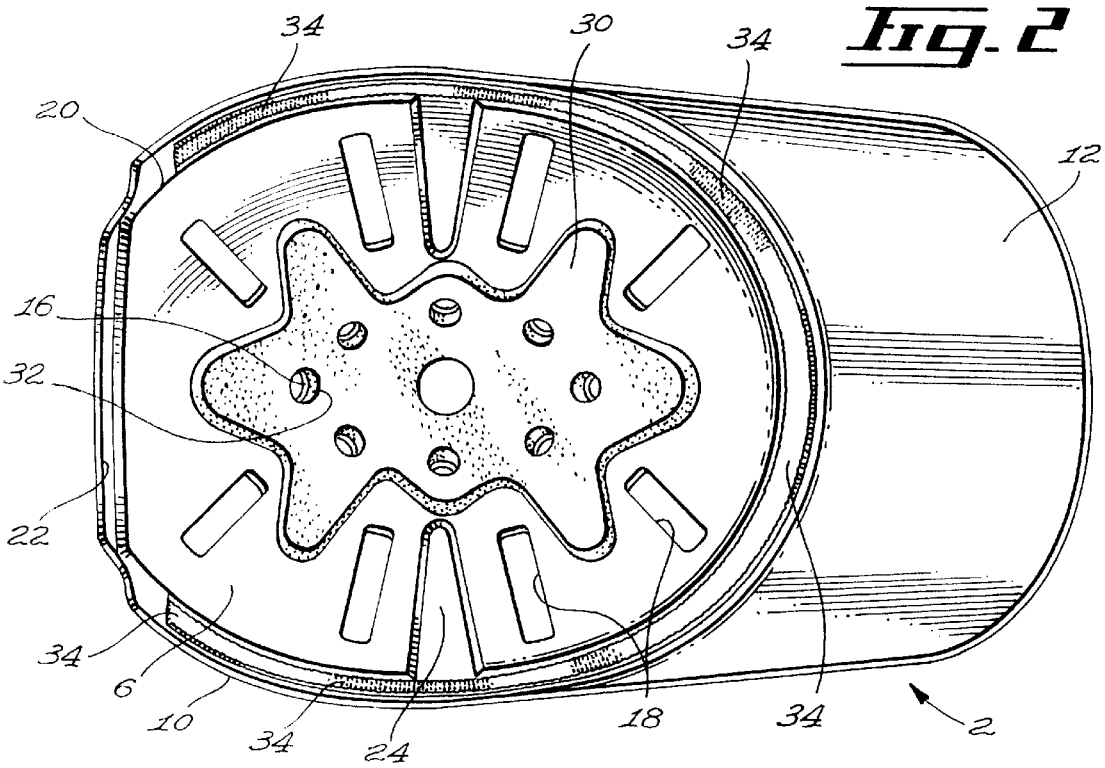
FIG. 2 is a bottom plan view of the shell.

The safety cap of the invention is comprised of a shell 2 and a flexible cloth cover 4. Shell 2 is made of a one piece impact-resisting rigid material and is molded from a thin sheet of plastic such as ABS. Shell 2 is composed of a dome shape body 6 adapted to fit the wearers head, said body having a top portion and a lower rim 8 with an exposed edge 10. A front visor 12 is integrally formed with body 6 which also has a rear semi-circular recess 14 for the passage of a wearer pony tail if the wearer is so provided with. Recess 14 has a rim 15 which merges with body rim 8. Body 6 has circular upper ventilation openings 16 disposed in a circle and a set of vertically extending lower elongated ventilation openings 18. Rims 8 and 15 are outwardly offset from the rest of the body 6, defining steps 20 and 22 respectively, to further reinforce the shell against impact, similarly, the body 6 is further provided with vertical ribs 24 formed by outwardly offset portions of the body sheet. A top circular offset portion 26 is also provided at the center of the shell 2. As shown in FIG. 7, the side edge portions of the body back semi-circular recess 14 which merge with rim 8 form enlargements 28 to increase the width of the body recess 14 at the level of rim 8.

A top pad 30, made of sponge rubber, is adhered to the inside surface of the top portion of shell body 6 and is formed with circular holes 32 in register with the ventilation openings 16. It is noted that the top pad 30 does not mask in anyway the lower, elongated, vertical, ventilation openings 18.

The inside surface of rim 8 is covered by a hook fastener band 34 which is adhered thereto. Band 34 preferably extends all around the shell body 6 except at the back recess 14.

The cloth cover 4 is preferably made of woven coton and is air permeable; it preferably has a decorative pattern and is of any desired color or color combination to have an esthetic value; it is made of gussets 36 stitched together by stitching lines 38 and a decorative top button 40 is stitched to the top of the cover.

The cover has a rearwardly extending pocket 42 formed of a top panel 44 and of a bottom panel 46 stitched together by stitch line 48. The cover and pocket are of a size and shape to snugly fit the shell body 6 and shell visor 12 respectively.

A flange 50, made of a double layer fabric to form a sleeve, is attached to the lower edge of the gussets 36 by means of a stitch line 52. Sleeve forming flange 50 is also attached by stitch line 52 to the rear free edge of the bottom panel 46 of the pocket 42. The two layers forming the sleeve of flange 50 are attached together along the bottom edge of the sleeve by means of bottom stitch line 54. A cushion pad 56 in the form of a strip is inserted within sleeve 50 and extends all around flange 50 except for certain areas indicated by crossed-stitch lines . These padless areas 57 are located at both sides and at the front of the cap.

A loop fastener band 58 is stitched to the flange 50 along the entire length of its inside face except for terminal flange portions 51 as shown in FIG. 7.

The cloth cover 4 is of a size and shape to conform with the outside of the shell 2, the stitch line 52 coinciding with the exposed edge 10 of the body 6 when the cloth cover 4 is fitted on the shell 2.

Figure 3:
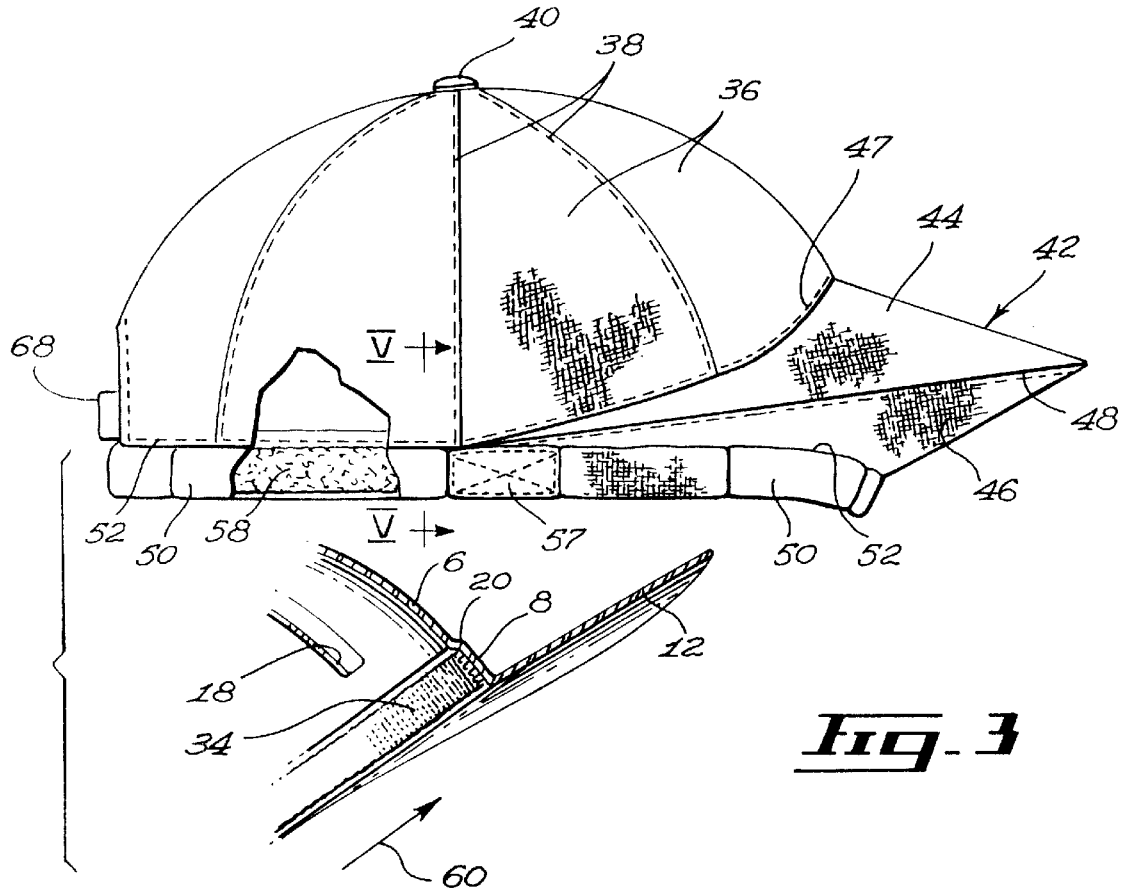
FIG. 3 is a side elevation of the cover in the position to receive the shell shown in partial longitudinal section.

As shown in FIG. 3, pocket 42 is opened to facilitate shell visor insertion into the pocket in accordance with arrow 60. The remaining portion of the cover is then fitted over the body 6; at this stage, flange 50 freely depends from shell body 6 all around the exposed edge 10 of the latter including the junction of visor 12 with body 6. This is the non folded position of flange 50. Then flange 50 is folded .inwardly in accordance with arrow 62 in FIG. 5 so that the flange 50 now underlies and covers exposed edge 10 around body 6. Loop fastener band 58 is then pressed against and releasably adheres to hook fastener band 34 secured to the inside of shell body rim 8.

Flange 50 not only serves to maintain the cover in position on shell body 6 but also serves as a cushion to contact the wearer's head except at the thinner padless areas 57 which provide ventilation passages between flange 50 and the wearer's head. Air enters body 6 through these passages at areas 57 and issues through ventilating openings 18 and 16 and air permeable cloth cover 4.

The back of cloth cover 4 has a semi-circular recess 63 which registers with half circular shell body recess 14. A buckle 64 is carried by a strap 66 stitched to one side of recess 63 while a strap 68 is directly stitched to the opposite side of recess 63, this strap 68 having fastener means more particularly a hook fastener band 70 and a loop fastener band 72 disposed on the inner side of strap 68. This forms a length adjustable fastener means since once strap 68 is inserted through buckle 64 and looped around itself, male fastener 70 may be adhered to any selected area of the female fastener band 72. Straps 66, 68 are stitched to cover 4 at the level of body rim 8 and, in fastening position extends across the back body recess enlargements 28. Similarly terminal portions 51 of folded flange 50 freely enter enlargements 28. It follows that folded padded flange 50 can be tightened by fastener 64, 66, 68 around wearer's heads of smaller contour sizes than that of shell body rim 8.

In another embodiment, shell 2 does not have a visor 12 and cloth cover 4 has a front semi-rigid visor instead of pocket 42.

I claim:

1. A safety cap comprising a one piece shell made of an impact-resistant, rigid material and forming a dome shaped wearer's head fitting body defining a top portion and a lower head encircling rim with an exposed edge, said body having ventilation openings made therethrough and extending short of said rim, a cloth cover covering said body downto said exposed edge and having a foldable dependent flange which, when not folded, hangs down loosely from said cover along said exposed edge and which when folded underlines and covers said exposed edge and is applied against the inside of said rim, fastener means for releasably securing said flange folded against the inside of said rim, said cloth cover completely covering said body including said ventilation openings but being air permeable;

and a cushioning pad carried by said flange and interposed between said rim and the wearer's head when said flange is folded.

2. A safety cap as defined in claim 1, wherein said fastener means include releasably interhooking hook and loop fastener bands adhered to said flange and to the inside of said rim.

3. A safety cap as defined in claim 1, wherein said flange is made of a double layer fabric and forms a sleeve, said cushioning pad enclosed within said sleeve.

4. A safety cap as defined in claim 3, wherein each of said body and cover has a back recess with opposite side edges of said body recess formed with enlargements at the level of said rim, said cover back recess registering with said body back recess except for said enlargements, said sleeve and enclosed cushioning pad having end portions which, when said flange is folded, freely extend within said enlargements, and length adjustable fastener straps secured to said cover and extending across both said back recesses and said enlargements.

5. A safety cap as defined in claim 4, further including a visor integral with and forwardly extending from said body, said cloth cover forming a rearwardly opened front pocket for receiving and snugly covering said visor, said pocket defining a top and a bottom layer, said flange secured to and extending along said bottom layer, said flange completely surrounding the wearer's head except at said body and cover back recesses.

6. A safety cap as defined in claim 4, wherein said body is formed of a thin molded plastic sheet and said rim is outwardly offset relative to said body to reinforce the latter.

7. A safety cap as defined in claim 6, wherein said body is formed with body reinforcing outwardly offset vertical zones disposed between said ventilation openings.

8. A safety cap as defined in claim 7, further including a visor integral with and forwardly extending from said body, said cloth cover forming a rearwardly opened front pocket for receiving and snugly covering said visor, said pocket defining a top and a bottom layer, said flange secured to and extending along said bottom layer, said flange completely surrounding the wearer's head except at said body and cover back recesses.

9. A safety cap as defined in claim 1, further including an additional cushioning pad adhered to the inside of the top portion of said body, said top portion being provided with circular ventilation openings, said additional pad having holes in register with said circular ventilation openings.

10. A safety cap as defined in claim 4, further including an additional cushioning pad adhered to the inside of the top portion of said body, said top portion being provided with circular ventilation openings, said additional pad having holes in register with said circular ventilation openings.

11. A safety cap as defined in claim 4, further including an additional cushioning pad adhered to the inside of the top portion of said body, said top portion being provided with circular ventilation openings, said additional pad having holes in register with said circular ventilation openings.

12. A safety cap as defined in claim 5, further including an additional cushioning pad adhered to the inside of the top portion of said body, said top portion being provided with circular ventilation openings, said additional pad having holes in register with said circular ventilation openings.

13. A safety cap comprising a one piece shell made of an impact-resistant,rigid material and forming a dome shaped wearer's head fitting body defining a top portion and a lower head encircling rim with an exposed edge, said body having ventilation openings made therethrough and extending short of said rim a cloth cover covering said body down to said exposed edge and having a foldable dependent flange which when not folded, hangs down lossely from said cover along said exposed edge and which when folded underlines and covers said exposed edge and is applied against the inside of said rim, fastener means for releasably securing said flange folded against the inside of said rim, said cloth cover completely covering said body including said ventilation openings but being air permeable; wherein said body is formed of a thin molded plastic sheet and said rim is outwardly offset relative to said body to reinforce the latter.

14. A safety cap as defined in claim 13, wherein said body is formed with body reinforcing outwardly offset vertical zones disposed between said ventilation openings.

* * * * *